United States Patent [19]

Kato et al.

[11] 4,425,894

[45] Jan. 17, 1984

[54] FUEL INJECTING DEVICE

[75] Inventors: Masaaki Kato, Toyoake; Tetsuji Akashi, Oobu, both of Japan

[73] Assignee: Nippondenso Co., Ltd., Kariya, Japan

[21] Appl. No.: 421,496

[22] Filed: Sep. 22, 1982

[30] Foreign Application Priority Data

Sep. 25, 1981 [JP] Japan ..... 56-152358
Oct. 2, 1981 [JP] Japan ..... 56-157899

[51] Int. Cl.[3] ..... F02M 57/02

[52] U.S. Cl. ..... 123/446; 123/500; 239/88

[58] Field of Search ..... 123/446, 500, 503, 445, 123/495, 501, 502; 239/88-91

[56] References Cited

U.S. PATENT DOCUMENTS

| | | | |
|---|---|---|---|
| 4,129,253 | 12/1978 | Bader et al. | 239/88 |
| 4,235,374 | 11/1980 | Walter et al. | 239/90 |
| 4,317,541 | 3/1982 | Beardmore | 239/88 |
| 4,327,694 | 5/1982 | Henson et al. | 123/500 |
| 4,378,774 | 4/1983 | Kato | 123/446 |
| 4,385,609 | 5/1983 | Kato | 123/446 |

FOREIGN PATENT DOCUMENTS

| | | | |
|---|---|---|---|
| 54-50726 | 4/1979 | Japan . | |
| 56-96154 | 8/1981 | Japan | 123/446 |
| 57-2458 | 1/1982 | Japan | 239/91 |

*Primary Examiner*—Ira S. Lazarus
*Assistant Examiner*—Magdalen Moy
*Attorney, Agent, or Firm*—Cushman, Darby & Cushman

[57] ABSTRACT

A fuel injecting device has a fuel pump and a fuel injector. The fuel injector comprises a housing having a first bore and second bore, a delivery plunger inserted in the first bore for reciprocation and driven by an engine in synchronism therewith, a delivery pump chamber defined between the first bore and the delivery plunger, an injection plunger inserted in the second bore for reciprocation, an injection pump chamber defined between the second bore and one end of the injection plunger, a pressure chamber defined between the second bore and the other end of the injection plunger for communicating with the delivery pump chamber, an injection nozzle connecting with the injection pump chamber, a feed port formed in the housing and operatively opening into the delivery pump chamber for conducting fuel into the delivery pump chamber, a timing port formed in the housing and operatively opening into the delivery pump chamber, the timing port being so located that the timing port is closed by the delivery plunger after the feed port is closed by the delivery plunger, and that the latest injection timing is determined when the timing port is closed by the delivery plunger during injection at the latest injection timing, a spill port formed in the housing and connecting with the injection pump chamber for determining the injection termination, a drain port formed in the housing and connecting with the pressure chamber at the latest immediately after the injection termination, a metering passage connecting with the injection pump chamber for supplying fuel to the injection chamber, and a check valve in the metering passage for preventing the fuel supplied to the injection pump chamber from flowing backward. The fuel injecting device further comprises a pump for raising the pressure of fuel from the fuel tank to a predetermined level, a metering element connecting the pump with the metering passage for metering the fuel supplied to the injection pump chamber, a timing control element connecting with the timing port through a timing passage for controlling the starting time of the fuel injection by closing the timing passage, an orifice formed in the timing passage, and a fuel supplier connecting with the feed port for supplying fuel from the fuel tank to the delivery pump chamber when the delivery plunger is raised.

13 Claims, 8 Drawing Figures

FUEL INJECTING DEVICE

BACKGROUND OF THE INVENTION

This invention relates to a fuel injecting device for supplying fuel to a Diesel engine, more specifically to a fuel injecting device for an internal combustion engine including a so-called unit injector in which an injection valve for each cylinder is integral with a pump section for high-pressure fuel supply.

In order to improve the combustion efficiency of a Diesel engine, it is necessary to increase fuel injection pressure. A conventional injecting device generally uses an injection pressure of approximately 700 atms. However, higher injection pressure is required for improved combustion efficiency, and the conventional device cannot meet this requirement.

For the high-pressure injection, there is proposed the so-called unit injector in which an injection valve is integral with a pump section for supplying high-pressure fuel to the valve.

In a unit injector of this type disclosed in USP No. 4,235,374, a primary pumping plunger driven by an engine and a secondary plunger for delivering high-pressure fuel to a nozzle are fitted in a unit injector housing for reciprocation. A timing chamber is defined between the primary and secondary plungers, while a metering chamber is defined between the secondary plunger and the nozzle. The timing chamber is supplied with fuel through a conduit, which is opened and closed by a control valve for determining the injection timing.

In this prior art device, high pressure in the timing chamber is directly applied to the control valve till the injection is finished after the conduit is closed by the control valve. Thus, the prior art device is subjected to many problems regarding the durability and working accuracy of the control valve.

Immediately after the conduit is closed, the pressure inside the timing chamber is suddenly increased and applied to the control valve. To protect the control valve against such high pressure, an orifice may be provided between the control valve and the timing chamber. In this case, however, fuel for the next process should be supplied to the timing chamber through the orifice when the primary plunger is raised. It is therefore impossible to make quick fuel supply.

SUMMARY OF THE INVENTION

The object of this invention is to provide a fuel injecting device obviating the aforementioned drawbacks or problems.

According to this invention, there is provided a fuel injecting device which comprises a unit injector including first and second bores formed in a housing of the unit injector, a delivery plunger and an injection plunger reciprocatingly inserted in the first and second bores, respectively, a delivery pump chamber defined by the first bore and the delivery plunger, a feed port operatively opening into the delivery pump chamber, and a timing port operatively opening into the delivery pump chamber timing control means connecting with the timing port and closing the timing port when the fuel injection begins, and an orifice disposed between the timing port and the timing control means.

Since pressure suddenly increased in the delivery pump chamber is applied to the timing control means through the orifice, the timing control means is greatly improved in durability.

According to this invention, moveover, the opening of the timing port is so located that the latest injection timing is determined when the timing port is closed by the delivery plunger during injection at the latest injection timing. Therefore, the delivery pump chamber does not continually connects with the timing control means, so that the timing control means is additionally improved in durability.

BRIEF DESCRIPTION OF THE DRAWINGS

This invention will be fully understood from the following detailed description with reference to the accompanying drawings, in which.

DETAILED DESCRIPTION OF THE PREFERRED EMBODIMENTS

Figure 1:
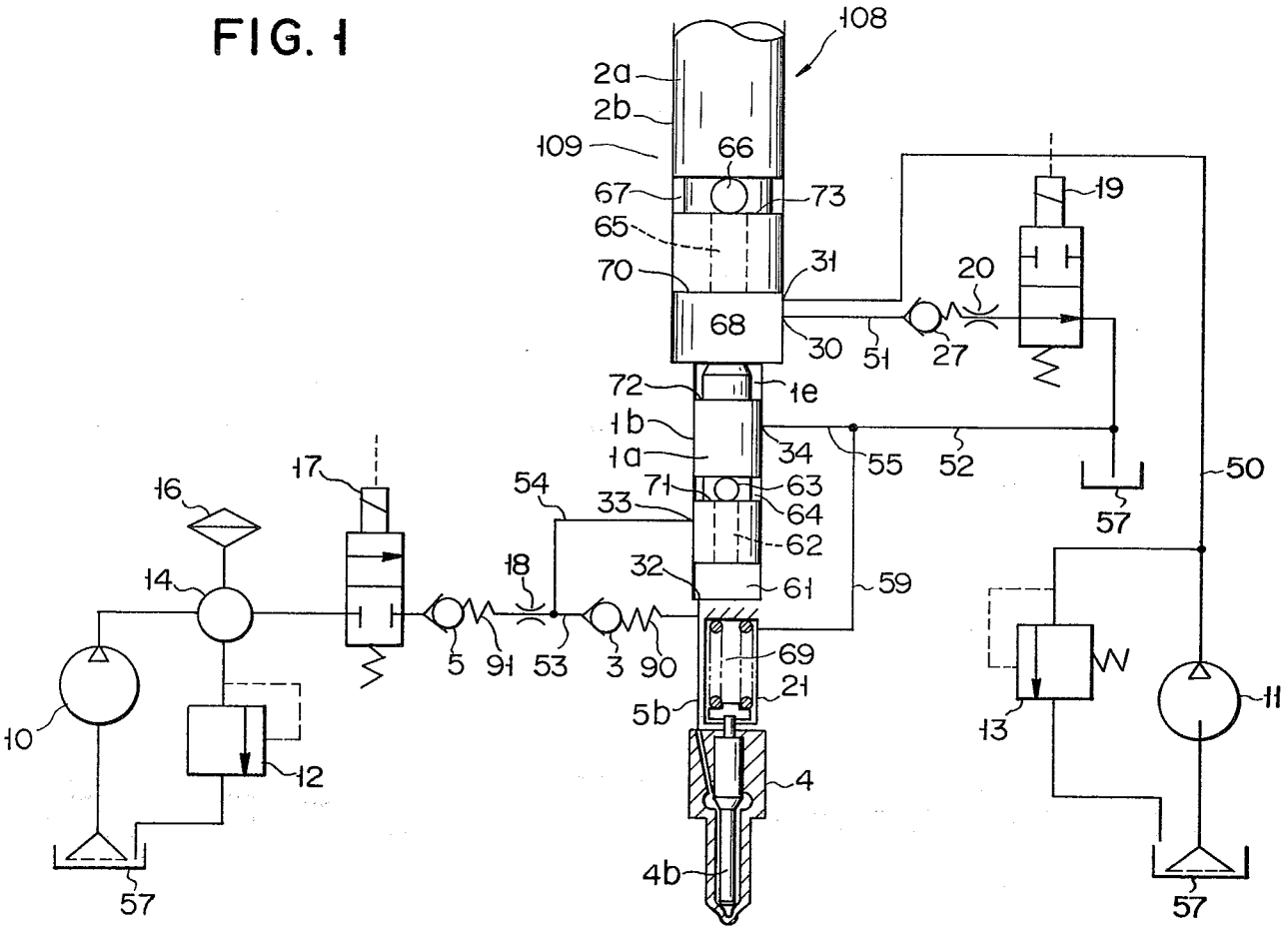
FIG. 1 shows one embodiment of the fuel injecting device of this invention.
Figure 2:
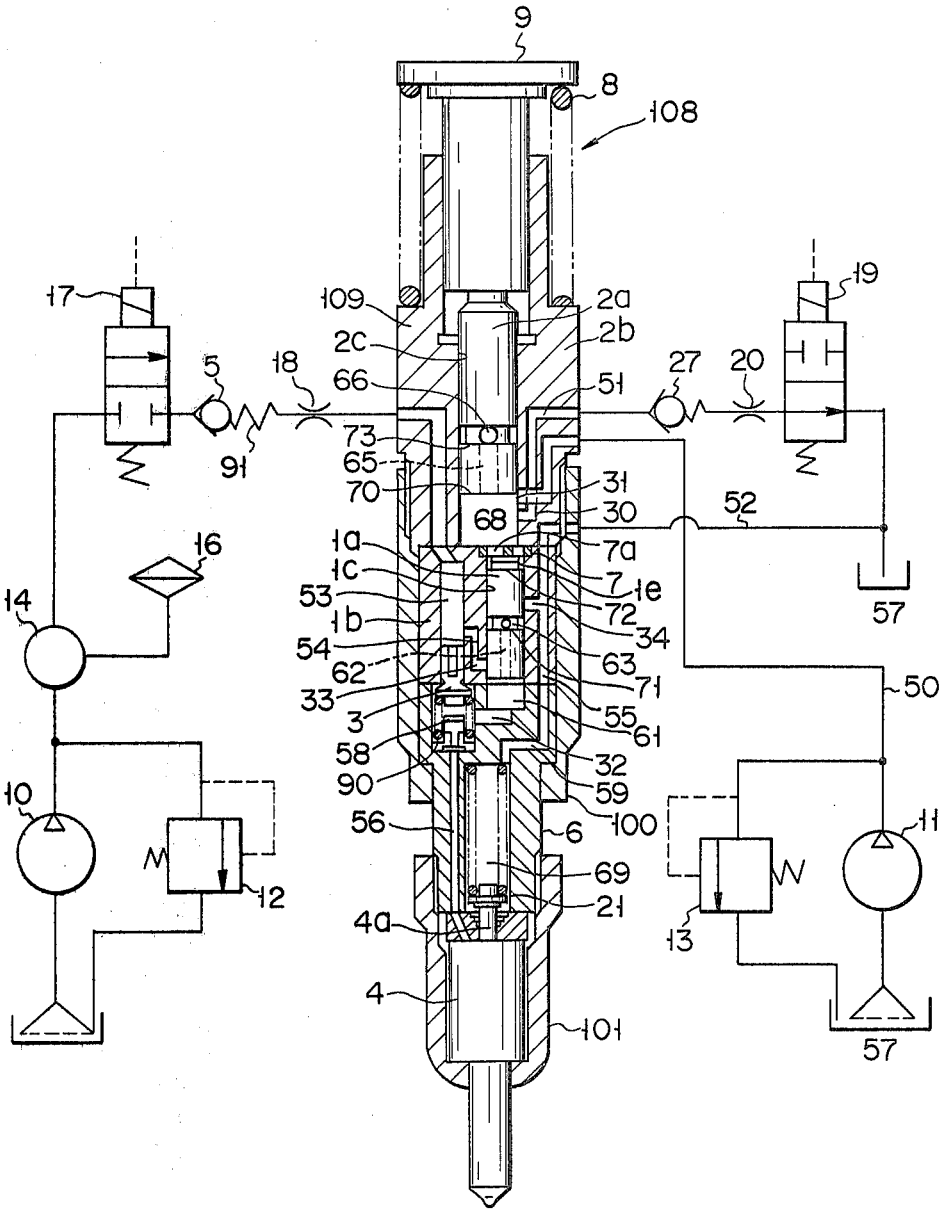
FIG. 2 is a longitudinal sectional view of a fuel injector used in the device shown in FIG. 1.

Referring now to FIGS. 1 and 2, the first embodiment of this invention will be described in detail. An injector 108 has an injection plunger 1*a* slidably fitted in a hole 1*c* of an injection cylinder 1*b*. A delivery plunger 2*a* with a diameter greater than that of the injection plunger 1*a* is slidably fitted in a hole 2*c* of a delivery cylinder 2*b* whose diameter is greater than that of the hole 1*c*. The injection cylinder 1*b* and the delivery cylinder 2*b* are coupled integrally. The delivery plunger 2*a* having a follower 9 at its upper end (FIG. 2) is driven downward in synchronism with an engine by a cam (not shown). The delivery plunger 2*a* is normally urged upward by a follower spring 8 disposed between the injection cylinder 1*b* and the follower 9. The combination of the delivery and injection cylinders 2*b* and 1*b* constitutes a housing 109 of the fuel injector 108.

The delivery cylinder 2*b* has a feed port 31 and a timing port 30, while the delivery plunger 2*a* is provided with a timing lead 70 for opening and closing the timing port 30, a second spill lead 73 for opening and closing the feed port 31, and verticaly and horizontal holes 65 and 66 which connect a delivery pump chamber 68 and a annular groove 67.

Fuel in a fluid tank 57 is delivered by a second feed pump or metering pump 11 which is driven by the engine. The pump 11 may be of, for example, a mechanical type. The fuel, whose maximum pressure is determined by a safety valve 13, passes through a fuel supply passage 50, and is fed into the delivery pump chamber 68 via the feed port 31. The fuel in the delivery pump chamber 68 is discharged into the tank 57 through the timing port 30, a fuel discharge passage or a timing passage 51, a timing check valve 27, a timing orifice 20, and a timing solenoid valve 19. The timing orifice 20 has an inner diameter of approximately 1 mm, and is intended to prevent high pressure from the fuel from being directly applied to the seat surface of the timing solenoid valve 19.

The injection cylinder 1*b* has a spill port 33 and a drain 34 while the injection plunger 1*a* is provided with a spill lead 71 for opening and closing the spill port 33, a drain lead 72 for opening and closing the drain port 34, and vertical and horizontal holes 62 and 63 which connect an injection pump chamber 61 defined between the injection cylinder 1*b* and the lower end of the injection plunger 1*a* and an annular groove 64 formed in an intermediate portion of the injection plunger 1*a*. A nozzle holder 6 is formed at the lower portion of the invention cylinder 1*b*. The nozzle holder 6, the delivery cylinder 2*b*, and the injection cylinder 1*b* are assembled together by means of holder nut 100. The insertion plunger 1*a* is restrained in its downward and upward movements by the nozzle holder 6 and an injection plunger stop 7, respectively. The injection pump chamber 61 defined at the outlet of the injection cylinder 1*b* is surrounded by the injection cylinder 1*b* and the nozzle holder 6.

Fuel supplied from a first feed pump 10, which is driven by the engine, is delivered into the injection pump chamber 61 through a surge tank 14, a metering solenoid valve 17, a metering check valve 5 biased by a spring 91, a balance orifice 18, a metering passage 53, and a metering valve 3. An accumulator 16 attenuates the pulsation of the fuel in the surge tank 14 to maintain a constant liquid pressure level. A safety valve 12 adjusts the pressure of the supplied fuel to a constant level. The injection pump chamber 61 connects with an injection nozzle 4 by means of a metering port 32, a pressure regulating valve spring chamber 58 in the nozzle holder 6, and a fuel delivery passage 56. The entering valve 3 and a metering valve spring 90 are set in a metering valve spring chamber 58 formed in the injection cylinder 1*b*.

The nozzle 4 is fixed to the nozzle holder 6 by means of a retaining nut 101. The nozzle 4 is of a conventional type in which a nozzle hole is opened and closed by a needle valve 4*a*. The needle valve 4*a* is urged to close the nozzle hole by a nozzle spring 21 in the nozzle holder 6. A nozzle spring chamber 69 connects with a drain passage 55 by means of a communication passage 59. The drain port 34 also connects with the drain passage 55, which is connected with the tank 57 by means of a discharge passage 52.

When the delivery plunger 2*a* and the injection plunger 1*a* are at their respective top dead centers, a predetermined quantity of fuel corresponding to the quantity of fuel to be injected is filled into the injection pump chamber 61 by the first feed pump 10. The delivery pump chamber 68 is filled with fuel fed from the second feed pump 11. Thereafter, when the delivery plunger 2*a* is lowered from its top dead center by the cam (not shown), the fuel in the delivery pump chamber 68 is discharged through the feed port 31 and the timing port 30.

When the timing lead 70 first closes the feed port 31, the fuel is discharged through the timing port 30. However, the timing solenoid valve 19, which is disposed in the fuel discharge passage 51 through which the fuel from the timing port 30 is discharged, closes at the optimum injection timing according to such conditions as the engine speed, load, etc. When the solenoid valve 19 closes to stop the discharge of the fuel through the timing port 30, the fuel in the delivery pump chamber 68 is subjected to high pressure. Then, the fuel under high pressure passes through an opening 7*a* of the injection plunger stop 7 to press the upper end of the injection plunger 1*a*. As the fluid flows into a pressure chamber 1*e* defined between the injection cylinder 1*b* and the upper end of the injection plunger1*a* through the opening 7*a*, the injection plunger 1*a* is driven at a speed increased by an increment based on the ratio of pressure receiving surface area between the delivery and injection plungers 2*a* and 1*a*.

The seat section of the timing solenoid valve 19 is so designed as to receive the fuel under high pressure from the delivery pump chamber 68 through the timing check valve 27 and the timing orifice 20. Thus, only a small force is required to act on the seat of the solenoid valve 19. In other words, the electromagnetic driving force required may be small. Located in a position necessary for fuel injection with a maximum delay, the timing port 30 is closed by the timing leads 70 before the fuel pressure in the delivery pump chamber 68 reaches a high level. Accordingly, the solenoid valve 19 is subjected to no high pressure, and is therefore fully protected against breakage.

When the timing port 30 is closed, the injection pluger 1*a* is driven by the pressure inside the delivery pump chamber 68 to raise the pressure inside the injection pump chamber 61. When the delivery plunger 2*a* is further lowered to increase the pressure inside the injection pump chamber 61 to the pressure at which the nozzle 4 is opened, the needle valve 4*a* is pushed up against the nozzle spring 21 to start injection of fuel from the nozzle 4. At this time, the fuel injection pressure is adjusted to a very high level, e.g., 1,000 atms.

Then, the delivery plunger 2*a* is further lowered so that injection continues. When the spill lead 71 of the injection plunger 1*a* opens the spill port 33, the fuel under high pressure in the injection pump chamber 61 is returned to the metering passage 53 via the vertical hole 62 horizontal hole 63, annular groove 64, spill port 33, and a spill passage 54 formed in the injection cylinder 1*b*. As a result, the fuel pressure inside the injection pump chamber 61 is lowered, and the injection stops. Thereafter, the delivery plunger 2*a* is further lowered for a short distance to drive the injection plunger 1*a*. Then, the drain lead 72 opens the drain port 34, and the fuel under high pressure in the delivery pump chamber 68 is discharged into the tank 57 through a drain passage 55 in the injection cylinder 1*b* and a discharge passage 52. Hereupon, the actuation of the injection plunger 1*a* is stopped. However, the delivery plunger 2*a* is further lowered, and the spill lead 73 opens the feed port 31 of the delivery cylinder 2*b*. Then, the fuel in the delivery pump chamber 68 is discharged also through the feed port 31. The delivery plunger 2*a* is further lowered for a short distance to reach and stop at its bottom dead center.

Fuel once spilled into the metering passage 53 flows back into the injection pump chamber 61 from the spill port 33 or the metering valve 3 for repeated use. Thus, the metering effiency is improved.

When the delivery plunger 2*a* starts to rise from its bottom dead center, the feed port 31 is first closed by the spill lead 73. Then, the fuel pressurized by the first feed pump 10 is fed into the injection pump chamber 61, so that the injection plunger 1*a* is moved upward. Hereupon, the necessary quantity of fuel to be fed into the injection pump chamber 61 varies with the operating state of the engine. Accordingly, the open period of the metering solenoid valve 17 is controlled in accordance with theoperating state of the engine. when the engine is subjected to high load, the open period of the solenoid valve 17 is long enough to allow a large quantity of fuel to be fed into the injection pump chamber 61. If the engine load is reduced, the open period of the solenoid valve 17 is shortened to reduce the quantity of fuel supply. Even though the open or closed period of the solenoid valve 17 is controlled, it is impossible to supply a fixed quantity of fuel under varying pressure. According to this embodiment, therefore the fuel pressure is kept constant by the use of the safety valve 12, the surge tank 14, and the accumulator 16.

When the delivery plunger 2*a* further rises to open the feed port 31 again, the fuel is supplied from the second feed pump 11 to the delivery pump chamber 68. The delivery plunger 2*a* further rises for a short distance to reach and stop at its top dead center. Then, the delivery plunger 2*a* starts again to descend. Thereafter, these processes of operation are repeated.

In this embodiment as is evident from the above description, the injection quantity is controlled by metering the quantity of fuel supplied to the injection pump chamber 61. Also, the injection timing is controlled by governing the pressure rise beginning for the delivery pump chamber 68. The high injection pressure from the nozzle 4 is prevented from being directly applied to the pump chambers 61 and 68, so that the injection quantity and injection timing are stable.

Figure 3:
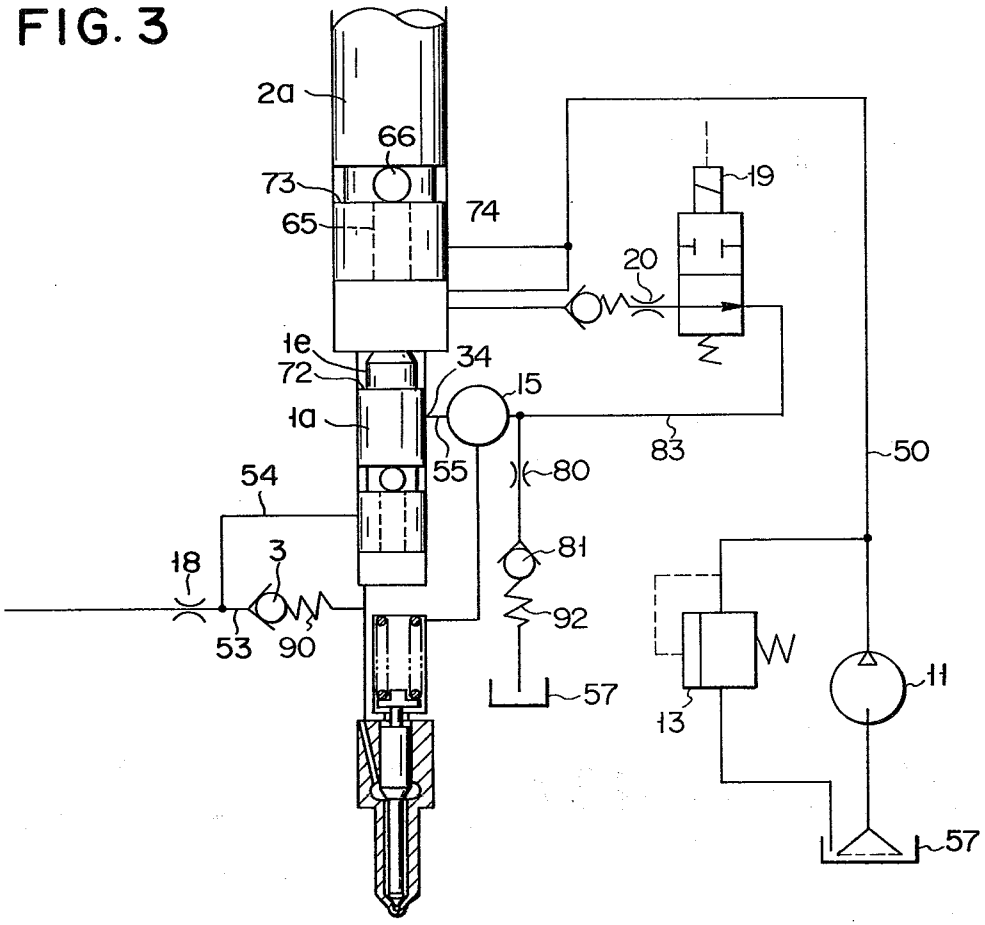
FIG. 3 shows another embodiment of the fuel injecting device of the invention.
Figure 4:
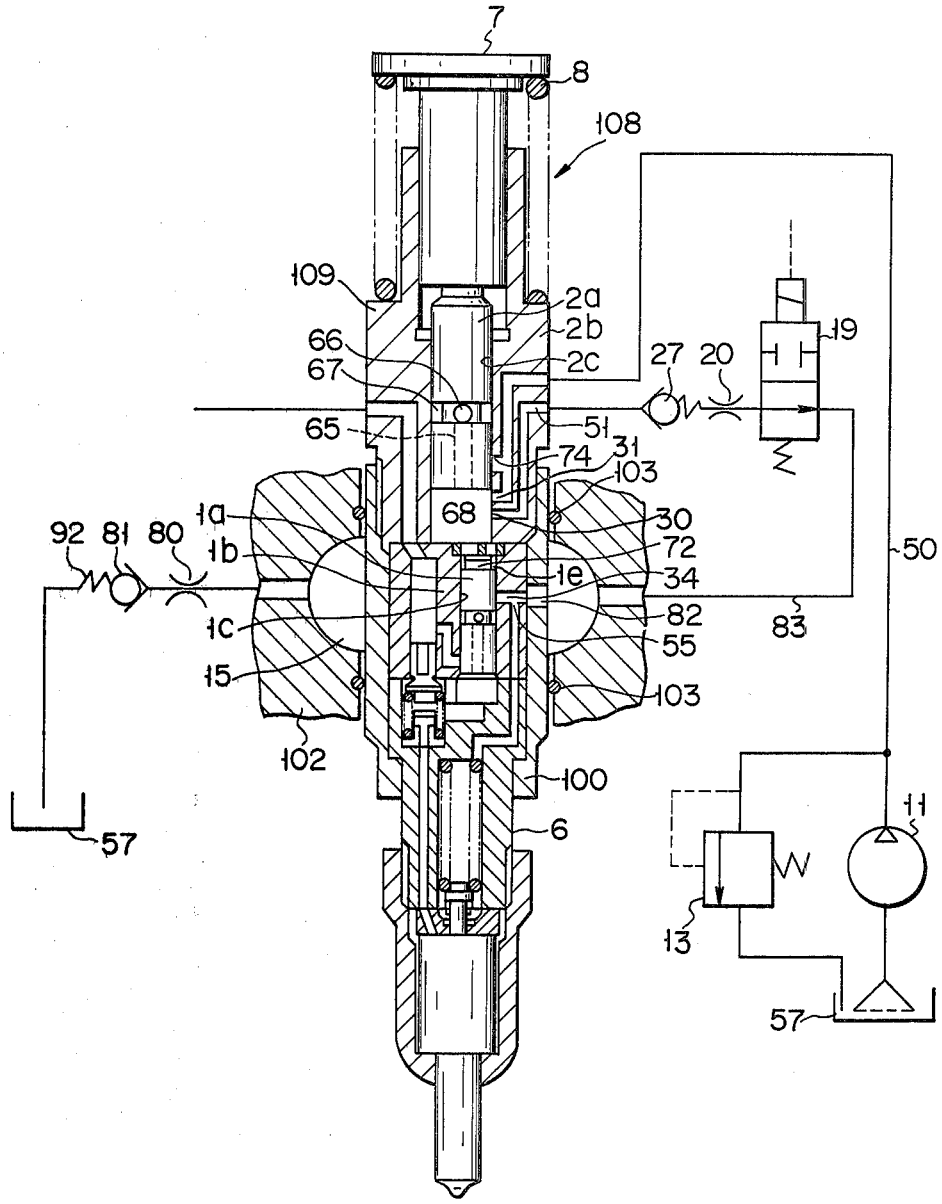
FIG. 4 is a longitudinal sectional view of a fuel injector used in the device shown in FIG. 3.

Referring now to FIGS. 3 and 4, the second embodiment will be described in detail. The second embodiment differs from the first embodiment in that a fuel gallery 15 is formed in an engine head 102. Oil-tightness between the holder nut 100 and the engine head 102 is maintained by means of an O-ring 103. Discharged fuel is supplied from the timing solenoid valve 19 to the fuel gallery 15 through a discharge passage 83, while drained fuel from the drain port 34 of the injection cylinder 1*b* is delivered to the fuel gallery 15 through drain passages 55 and 82. The fuel gallery 15 connects with the tank 57 by means of a gallery orifice 80 and a gallery check valve 81 which is urged by a gallery check valve spring 92 to set the injection-valve opening pressure. In the second embodiment a second spill port 74 is added to the feed port 31. According to this arrangement, the fuel discharged from the delivery pump chamber 68 can be collected in the fuel gallery 15 so as to be filled again through the drain port 34. Also, the fuel may effectively be filled into other cylinders to improve fuel utilization factor, and the pipe arrangement may be simplified.

Figure 5:
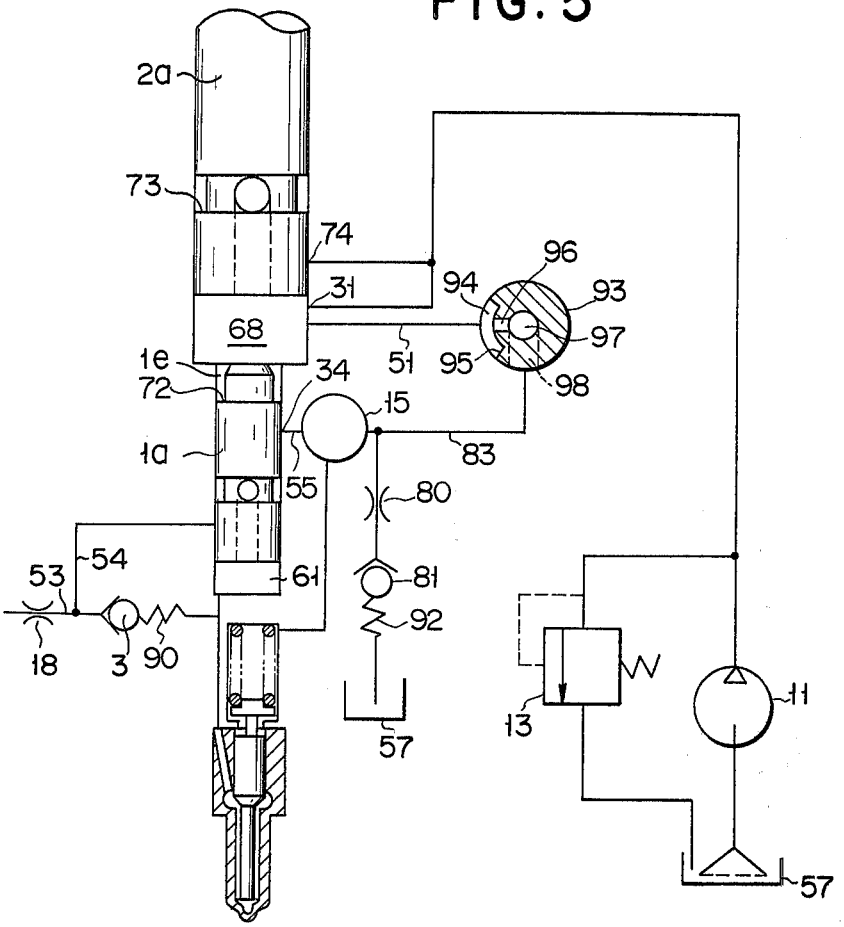
FIG. 5 shows still another embodiment of the fuel injecting device of the invention.
Figure 6:
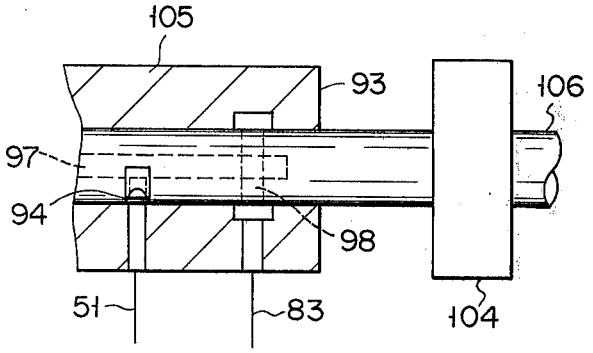
FIG. 6 shows a timing plunger-cylinder assembly of the fuel injecting device shown in FIG. 5.

Referring now to FIGS. 5 and 6, the third embodiment will be described in detail. The third embodiment differs from the second embodiment in that a timing plunger 93 is formed in a timing cylinder 105 instead of using the timing solenoid valve 19. The timing plunger 93 is coupled by means of a timer 104 with a timer shaft 106 which rotates in synchronism with a cam shaft (not shown) driven by the engine. According to this arrangement, the injection timing is controlled by a lead 95 formed in the timing plunger 93 to open and close the fuel discharge passage 51 by swinging the phase of the timer shaft 106 and the timing plunger 93 by means of the timer 104 (which is electrically controllable). Fuel delivered to the timing plunger 93 is led into the fuel gallery 15 through a port 94 in the plunger 93, a fuel passage 96 communicating with the port 94, a shaft bore 97 open to the passage 96, a radial hole 98 communicating with the bore 97, and the discharge passage 83 to which the hole 98 is connected.

In these embodiments, a single feed pump may suffice, and the spill leads 71 and 73 may be omitted.

Figure 7:
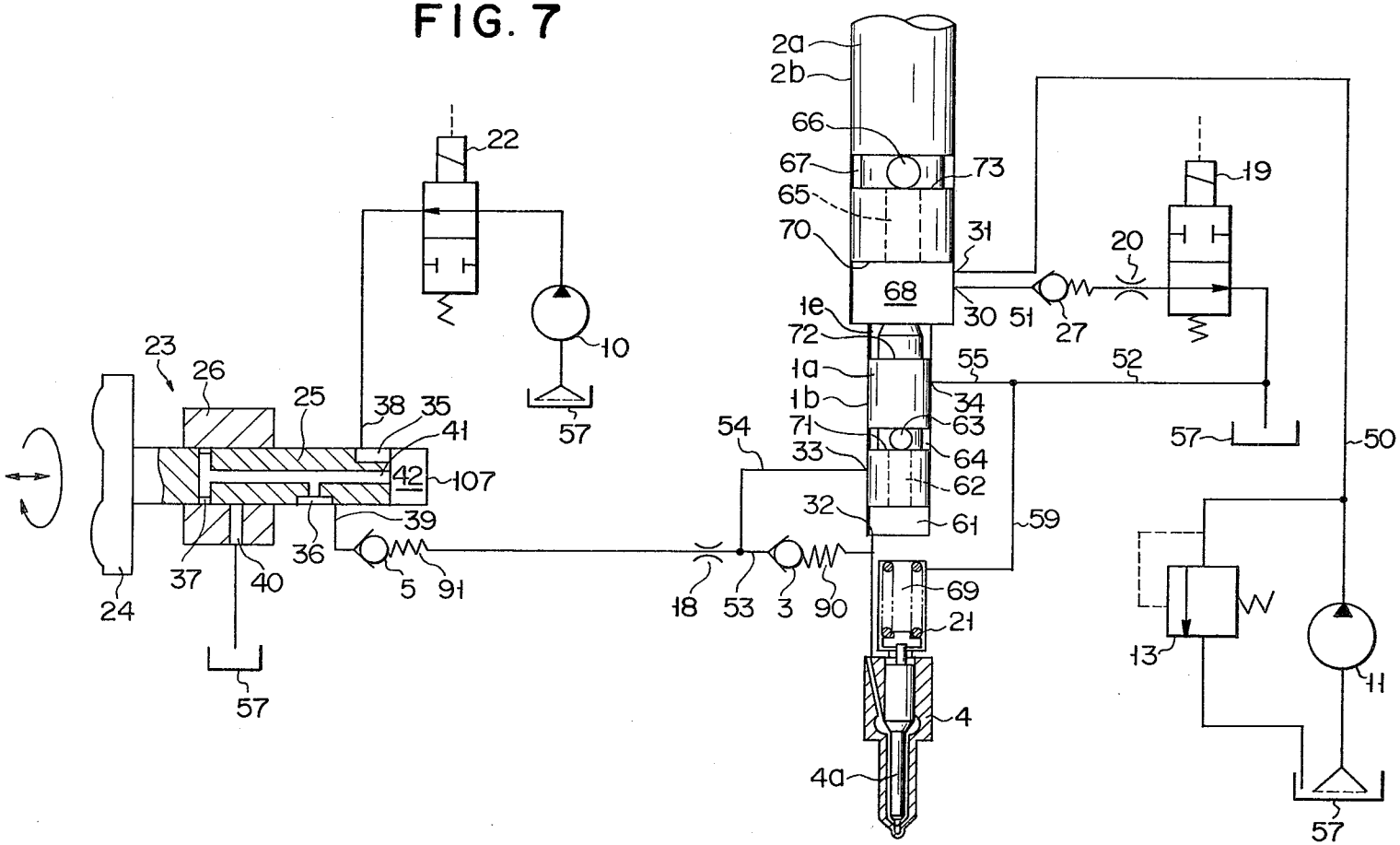
FIG. 7 shows a further embodiment of the fuel injecting device of the invention.
Figure 8:
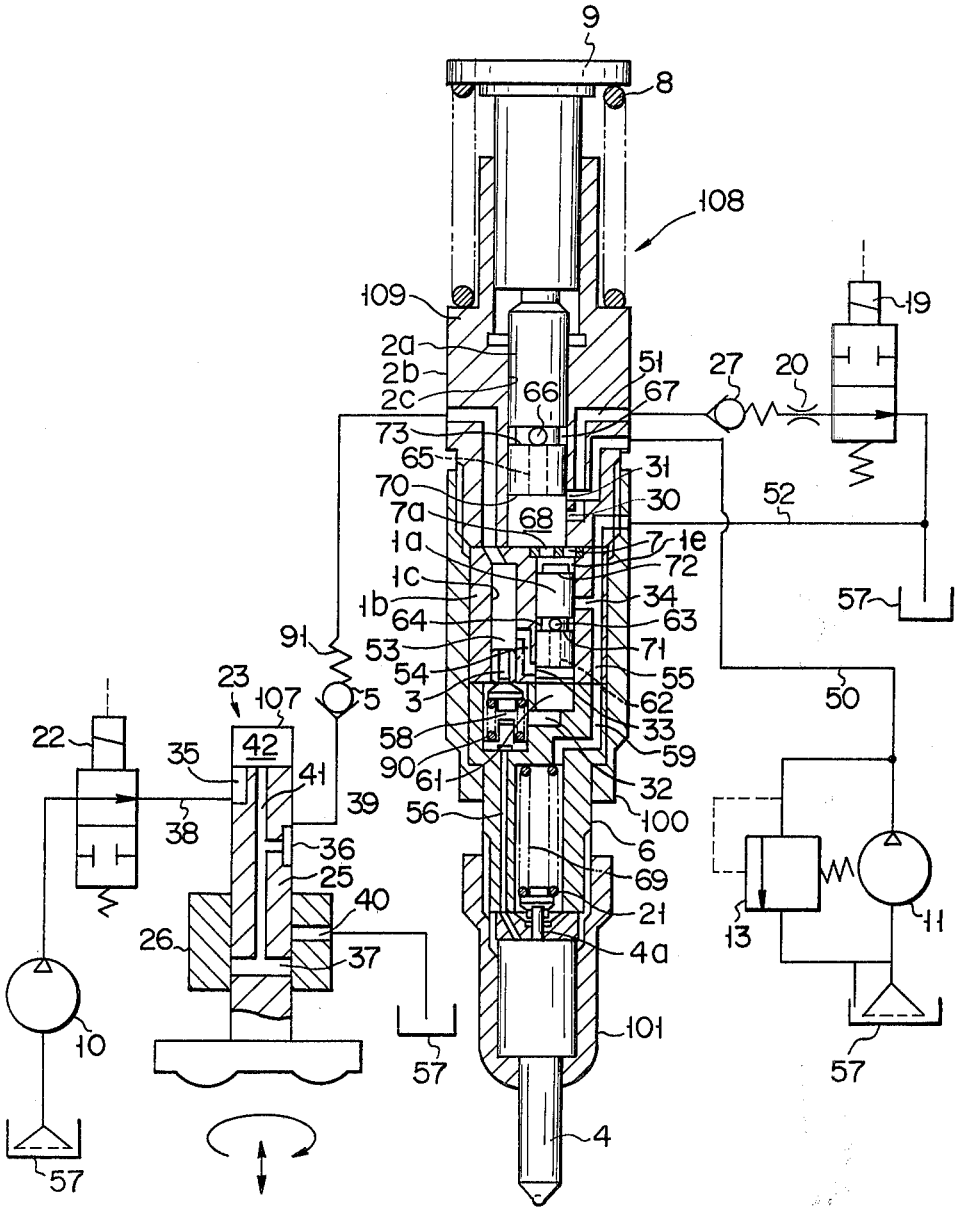
FIG. 8 is a longitudinal sectional view of a fuel injector used in the device shown in FIG. 7.

Referring now to FIGS. 7 and 8, the fourth embodiment will be described in detail. This embodiment differs from the embodiment shown in FIGS. 1 and 2 only in the construction of the control section adjoining the balance orifice 18 which is connected with the metering passage 53 and the spill passage 54. In the fourth embodiment, the control section comprises the first feed pump 10, a cut-off solenoid valve 22, a fuel metering pump 23, and the metering check valve 5.

Fuel supplied from the pump 10 is delivered into the injection pump chamber 61 via the cut-off solenoid valve 22, fuel metering pump 23, metering check valve 5, metering passage 53, and metering valve 3.

In this embodiment, a so-called distributor-type pump which is a mechanical fuel injection pump is used for the fuel metering pump 23. In FIG. 7, a face cam 24 is rotated in synchronism with the engine, and engages a cam (not shown) to reciprocate as the face cam 24 rotates.

A distribution plunger 25 fixed to the cam face 24 reciprocates in a distribution cylinder 107 as the face cam 24 reciprocates. A pump chamber 42 is defined between the distribution cylinder 107 and the distribution plunger 25. The distribution plunger 25 has a suction groove 35 connecting with the pump chamber 42, a discharge groove 36 connecting with a discharge port 39, an annular spill groove 37 formed in the plunger 25 and connecting with a spill passage 40, and a fuel hole 41 penetrating through the plunger 25 and connecting the pump chamber 42 with a discharge groove 36 formed around the plunger 25 and an annular spill groove 37 formed around the plunger 25 and communicating with the fuel hole 41. The spill passage 40 is formed in a spill ring 26, which slides on the plunger 25 in correspondence to the degree of depression of an accelerator of an automobile or engine speed.

The distributor-type pump 23 has the same construction as that of a pump used for fuel injection in a Diesel engine. Therefore, built in the pump 23 is the cut-off solenoid valve 22 which stops the fuel supply when the first feed pump 10 and the engine are stopped.

During a period after the delivery plunger 2*a* leaves its top dead center and until it reaches its bottom dead center, the fuel injecting device of this embodiment operates in the same manner as the device of the first embodiment. Accordingly, there will now be described only the operation of the fuel injecting device which is caused as the delivery plunger 2*a* rises.

When the delivery plunger 2*a* starts to rise from its bottom dead center, the feed port 31 is first closed by the spill lead 73. Then, the fuel pressurized in the metering pump 23 is introduced into the injection pump chamber 61, so that the injection plunger 1*a* is moved upward. Hereupon, the necessary quantity of fuel to be introduced into the injection pump chamber 61 varies with the operating state of the engine. Accordingly, the discharge of the metering pump 23 is controlled in accordance with the operating state of the engine. Namely when the engine is subject to high load, a large quantity of fuel is supplied to the injection pump chamber 61. If the engine load is reduced, the quantity of fuel supply is reduced.

Then, the fuel metering pump 23 operates as follows. The fuel supplied from the first feed pump 10 passes through the opened cut-off solenoid valve 22 to be led into the pump chamber 42 of the fuel metering pump or distributor-type pump 23. Then, the distribution planger 25 is reciprocated by the face cam 24 which is driven in synchronism with the engine. When the feed port 38 is closed by the suction groove 35, the fuel in the pump chamber 42 is pressurized to be discharged through the discharge groove 36, passing through the fuel hole 41 in the distribution plunger 25. The discharged fuel forcibly flows through the metering check valve 5 and the metering valve 3 against the urging forces of their respective springs 91 and 90, and is fed into the injection pump chamber 61.

When the distribution plunger 25 is driven until the annular spill groove 37 connects with the spill passage 40 in the spill ring 26 the fuel in the pump chamber 42 is discharged into the tank 57 through the spill passage 40. Thus, the fuel supply is stopped. In other words, the quantity of the discharged fuel corresponds to the delivery stroke of the distribution plunger 25 starting when the suction groove 37 is disconnected from the feed portion 38 and ending when the annular spill groove 37 connects with the spill passage 40. This quantity is controlled by horizontally sliding the spill ring 26 thereby to change the opening position of the spill passage 40. Since the spill ring 26 slides in correspondence to degree of accelerator depression or engine speed the quantity of the fuel delivered from the pump 23 is always adjusted to the optimum value corresponding to the operating state of the engine.

The injection plunger 1*a* forced up by the fuel introduced into the injection pump chamber 61. The pressure of the fuel fed from the fuel metering pump 23 into the injection pluger 1*a* is set to about 10 to 20 atms.

When the delivery plunger 2*a* further rises to open the feed port 31 again, the fuel is supplied from the second feed pump 11 to the delivery pump chamber 68. The delivery plunger 2*a* further rises a short distance to reach and stop at its top dead center. Then, the delivery plunger 2*a* starts again to descend. Therafter, these processes of operation are repeated.

In this fourth embodiment, the fuel metering pump is a distributor-type pump whose discharge can be metered. Regardless of the operating state of the engine, therefore, a desired quantity of fuel can always be supplied to the injection pump chamber 61. Thus, the injection is stabilized.

Since the conventional pump which has been used for fuel injection of a Diesel engine can be used for the fuel metering pump, it is unnecessary to provide any special pump for that purpose. Thus, the fuel injecting device can be reduced in cost.

Besides the distributor-type pump, a so-called in-line pump for the conventional use with a Diesel engine may also be employed for the fuel metering pump.

According to this invention, as described above, the delivery pump chamber and the injection pump chamber are provided separately, and are used for the control of injection timing and injection quantity respectively. Thus, the fuel injection is stabilized, and, in particular, the responsiveness of injection timing is improved.

The solenoid valves 17, 19 and 22 are controlled by an electronic control device, such as a microcomputer, which receives information from a sensor to detect various control values from the engine, computes the information or data, and transmits electric signals to the valves.

What we claim is:

1. A fuel injecting device comprising:

(I) A fuel injector including:

(a) a housing having first and second bores, (b) a delivery plynger inserted in said first bore for reciprocation and driven by an engine in synchronism therewith, (c) a delivery pump chamber defined between said first bore and said delivery plunger, (d) an injection plunger inserted in said second bore for reciprocation, (e) an injection pump chamber defined between said second bore and one end of said injection plunger, (f) a pressure chamber defined between said second bore and the other end of said injection plunger and communicating with said delivery pump chamber, (g) an injection nozzle connecting with said injection pump chamber, (h) a feed port formed in said housing and operatively opening into said delivery pump chamber, for conducting fuel into said delivery pump chamber, (i) a timing port formed in said housing and operatively opening into said delivery pump chamber, said timing port being so located that said timing port is closed by said delivery plunger after said feed port is closed by said delivery plunger, and that the latest injection timing is determined when said timing port is closed by said delivery plunger during injection at the latest injection timing, (J) a spill port formed in said housing and connecting with said injection pump chamber for determining the injection termination, (k) a drain port formed in said housing and connecting with said pressure chamber at the latest immediately after said injection termination, (l) a metering passage connecting with said injection pump chamber for supplying fuel thereto, and (m) a check valve is said metering passage for preventing the fuel supplied to said injection pump chamber from flowing backward;

(II) a fuel tank;

(III) a pump for raising the pressure of fuel from said fuel tanks to a predetermined level;

(IV) metering means connecting said pump with said metering passage for metering the fuel supplied to said injection pump chamber;

(V) timing control means connecting with said timing port through a timing passage, for controlling the starting time of the fuel injection by closing said timing passage;

(VI) an orifice formed in said timing passage; and (VII) means connecting with said feed port for supplying fuel from said fuel tank to said delivery pump chamber when said delivery plunger is raised.

2. The fuel injecting device according to claim 1 wherein said delivery plunger has an annular groove formed in an intermediate portion of the outer peripheral surface of said delivery plunger, said annular groove connecting with said feed port when said delivery plunger substantially reaches its bottom dead center, and communication means for connecting said delivery pump chamber with said annular groove.

3. The fuel injecting device according to claim 1 wherein said injection plunger has an annular groove formed in an intermediate portion of the outer peripheral surface of said injection plunger, said annular groove connecting with said spill port for suddenly reducing the pressure in said injection pump chamber when said injection plunger substantially reaches its bottom dead center, and communication means for connecting said injection pump chamber and said annular groove.

4. The fuel injecting device according to claim 1, wherein the diameter of said first bore is greater than that of said second bore.

5. The fuel injecting device according to any one of claims 1 to 4, further compirsing a check valve disposed between said orifice and said timing port in said timing passage.

6. The fuel injecting device according to any one of claims 1 to 4, further comprising a surge tank disposed between said pump and said metering means insaid metering passage.

7. The fuel injecting device according to claim 6, further comprising an accumulator connected with said surge tank for attenuating the pulsation of fuel in said surge tank to maintain a constant fuel pressure.

8. The fuel injecting device according to any one of claims 1 to 4, further comprising another check valve and another orifice disposed between said metering means and said injection pump chamber in said metering passage.

9. The fuel injecting device according to any one of claims 1 to 4, further comprising a fuel gallery having an orifice and a check valve connected therewith and connecting with said drain port, said fuel gallery connecting with said timing port through said timing control means and with said fuel tank through said first mentioned orifice and said first mentioned check valve.

10. The fuel injecting device according to any one of claims 1 to 4, wherein said timing control means is a solenoid valve to open and close said timing passage in accordance with the operating state of a related internal combustion engine.

11. The fuel injecting device according to any one of claims 1 to 4, wherein said timing control means is a timing plunger driven by an internal combustion engine to open and close said timing passage.

12. The fuel injecting device according to any one of claims 1 to 4, wherein said metering means is a solenoid valve to open and close said metering passage in accordance with the operating state of an internal combustion engine.

13. The fuel injecting device according to any one of claims 1 to 4, wherein said metering means is a mechanical fuel injection pump driven by an internal combustion engine.

* * * * *